United States Patent [19]

Steinbach

[11] Patent Number: 4,760,721

[45] Date of Patent: Aug. 2, 1988

[54] HANDLE FLANGE ASSEMBLY

[75] Inventor: Robert Steinbach, Glendale Heights, Ill.

[73] Assignee: Chicago Lock Company, Chicago, Ill.

[21] Appl. No.: 30,560

[22] Filed: Mar. 27, 1987

Related U.S. Application Data

[63] Continuation-in-part of Ser. No. 822,838, Jan. 27, 1986, abandoned.

[51] Int. Cl.[4] ..... E05B 13/10

[52] U.S. Cl. ..... 70/208; 70/418; 292/212; 292/346

[58] Field of Search ..... 70/208, 418; 292/212, 292/346

[56] References Cited

U.S. PATENT DOCUMENTS

| | | | |
|---|---|---|---|
| 685,188 | 10/1901 | Taylor | 70/418 |
| 770,408 | 9/1904 | Wells | 70/418 |
| 1,853,564 | 4/1932 | Jacobi | 70/208 X |
| 2,268,766 | 1/1942 | Monroe | 292/346 X |
| 2,378,837 | 6/1945 | Cohan | 292/346 |
| 3,089,330 | 5/1963 | Kerr | 70/208 |
| 3,316,742 | 5/1967 | Wellekens | 70/418 |
| 3,438,227 | 4/1969 | Wolniak | 70/208 |
| 3,550,412 | 12/1970 | Pitel et al. | 70/208 |
| 3,768,284 | 10/1973 | Kent et al. | 70/418 X |
| 4,611,477 | 9/1986 | Crites | 70/418 X |

*Primary Examiner*—Gary L. Smith
*Assistant Examiner*—Suzanne L. Dino
*Attorney, Agent, or Firm*—Basil E. Demeur; Robert E. Knechtel; Alan B. Samlan

[57] ABSTRACT

There is disclosed an improved handle lock assembly of the type generally including a handle lock barrel reciprocally carried relative to a lock stud, the lock stud having an interiorly threaded end for threadedly engaging a fixed stud aperture, the handle lock barrel and lock stud being carried within the confines of a fixed lock guide formed integrally with a handle flange including a handle recess into which the handle may be lockingly secured by a lock provided in the handle and having a bolt for securing the handle lock barrel to the lock guide against a bolt shoulder provided in the handle flange, the improvement consisting of bolt guide shield means carried on the lock guide and extending for a distance down the length of said lock guide, the bolt guide shield means encircling and completely enclosing the lock guide in a manner sufficient to prevent access to the bolt securing the handle lock relative to the handle flange when in the locked position, the bolt guide shield means formed integrally with the lock guide whereby unauthorized access to the bolt securing the handle lock within the handle recess when in the locked position is obviated.

2 Claims, 3 Drawing Sheets

FIG. 1 PRIOR ART
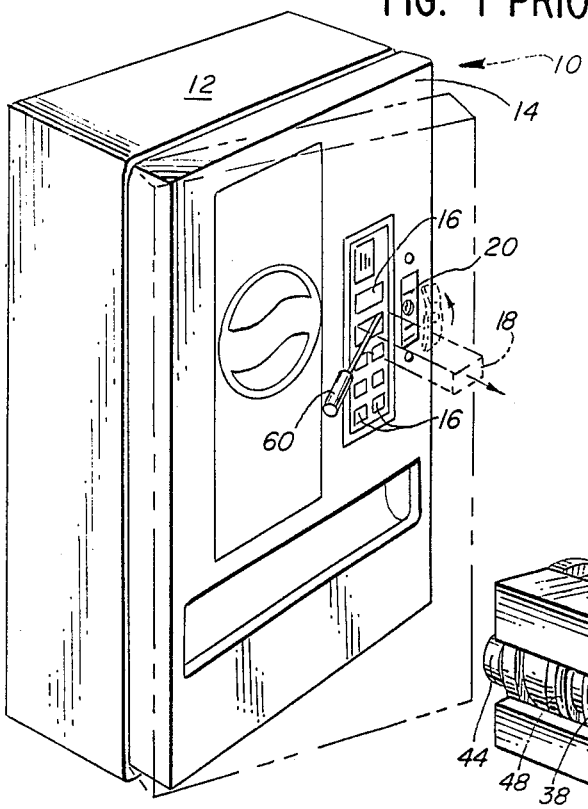
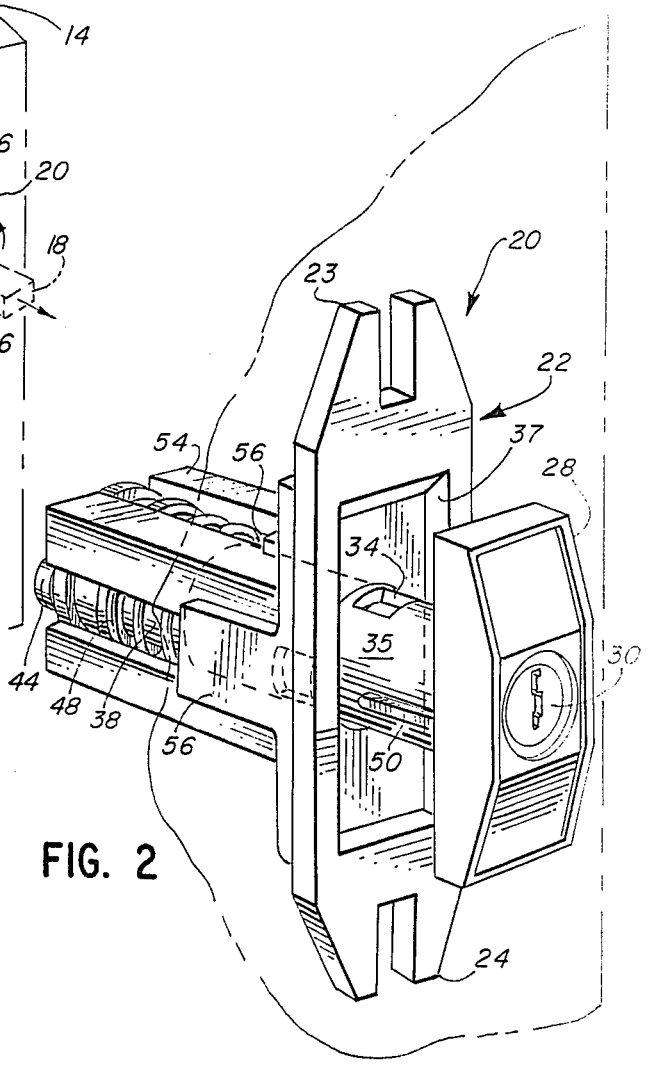
FIG. 2
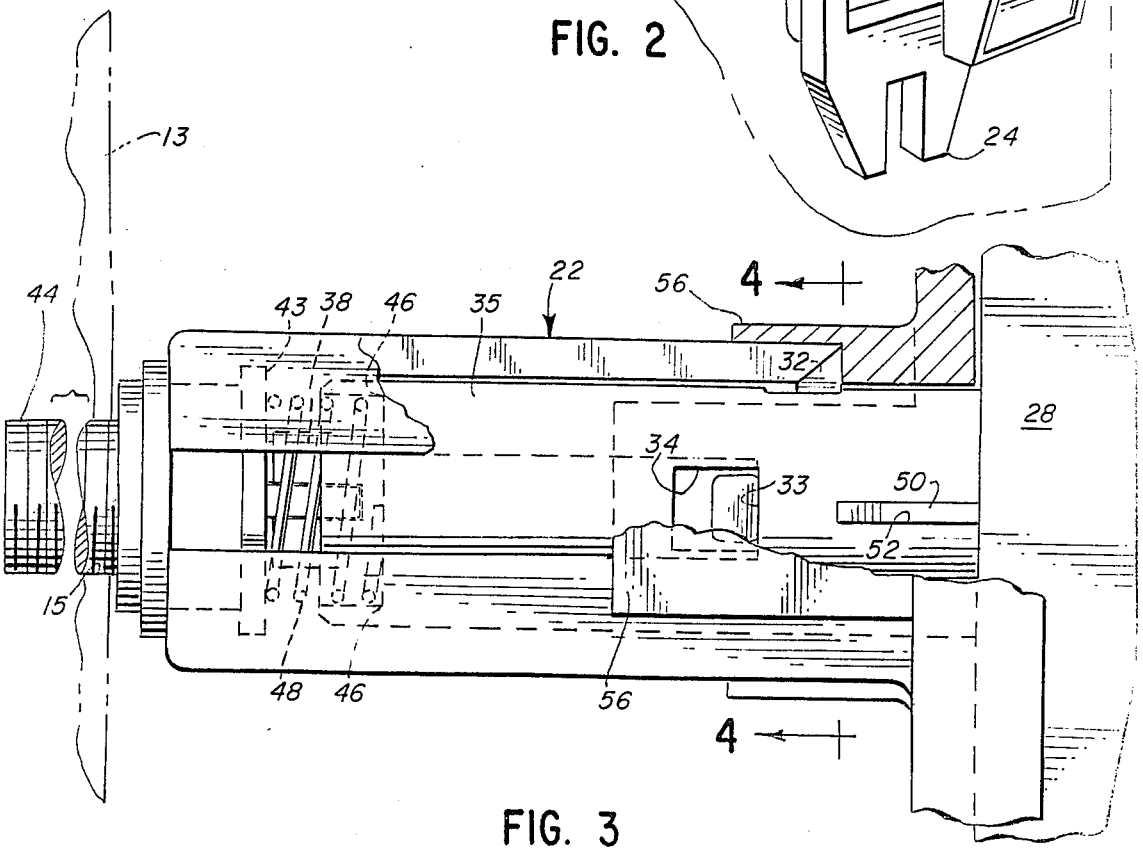
FIG. 3

FIG. 4
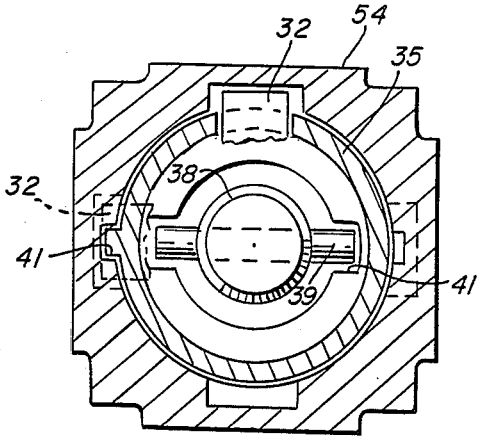
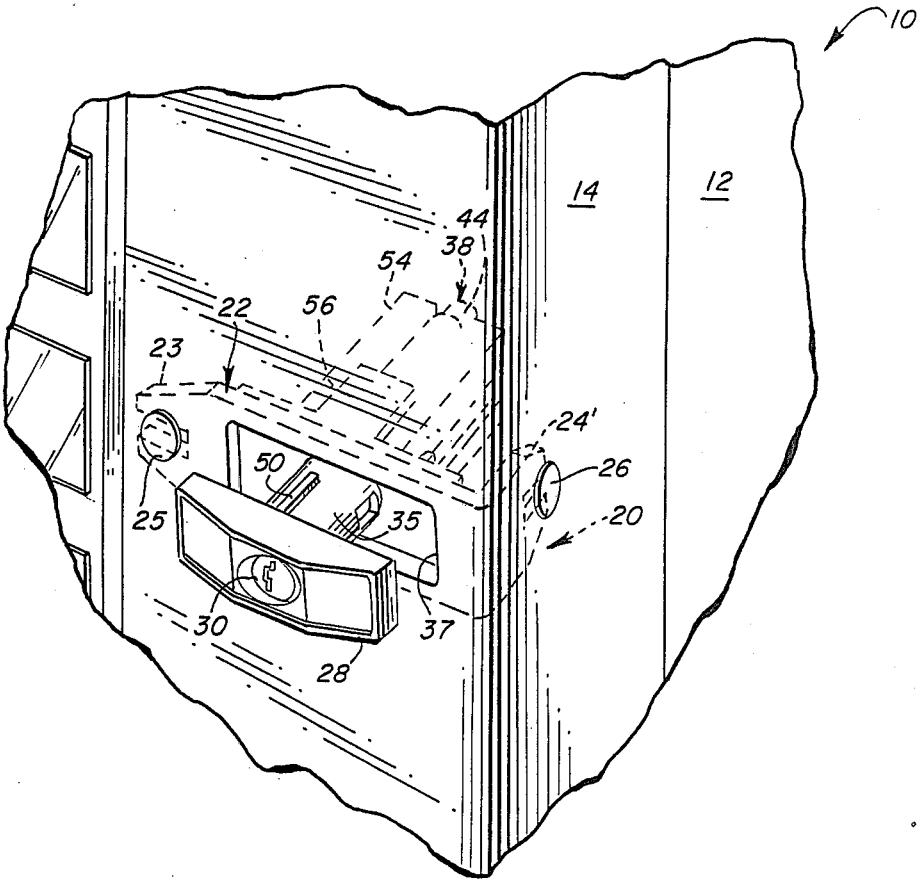
FIG. 5

FIG. 6
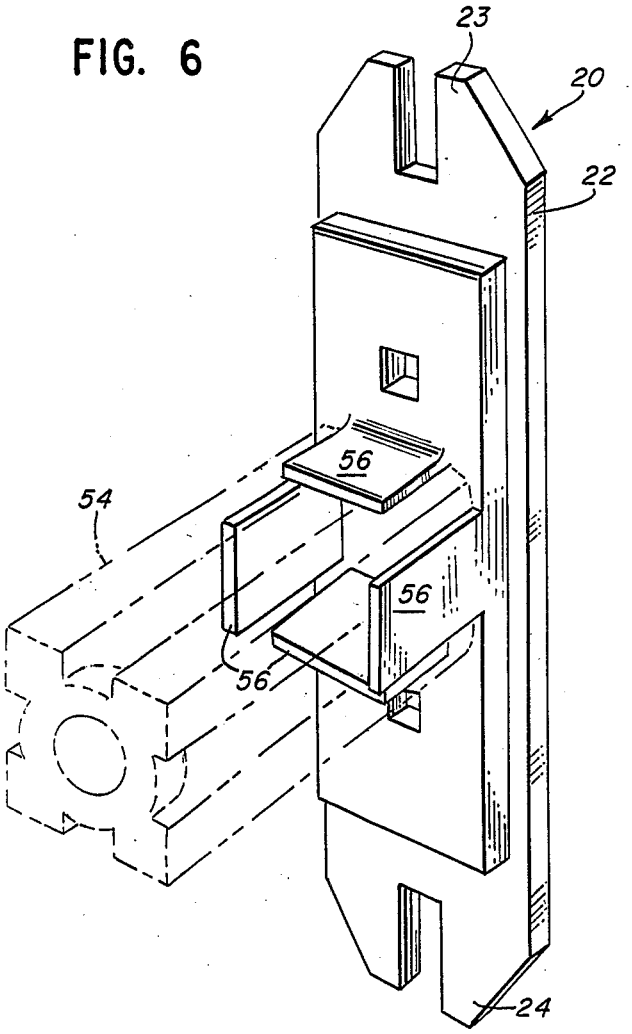
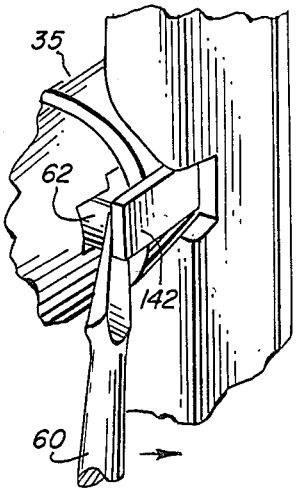
FIG. 7
PRIOR ART
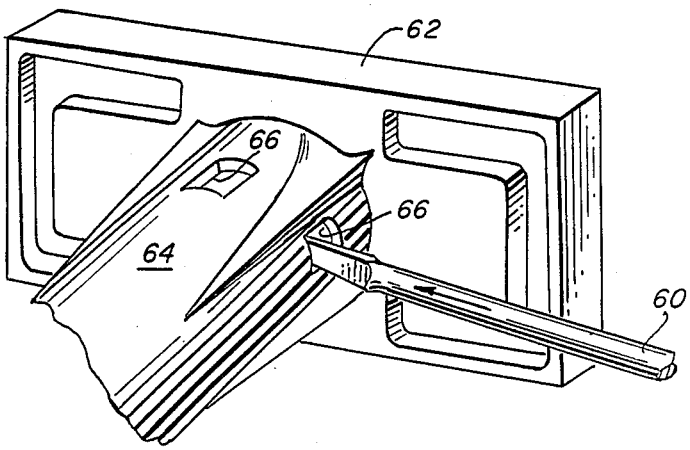
FIG. 8
PRIOR ART

HANDLE FLANGE ASSEMBLY

CROSS-REFERENCE TO RELATED APPLICATION

This application is a continuation-in-part of application Ser. No. 822,838 filed on Jan. 27, 1986 now abandoned entitled "Improved Handle Flange Assembly", filed in the name of Robert Steinbach as inventor, and assigned to Chicago Lock Company.

BACKGROUND OF THE INVENTION

The present invention concerns itself with an improvement to a handle lock assembly of the type generally used in vending machines.

In accordance with the current state of the art, it is well known that a variety of vending machines are presently available, such vending machines intended for vending a wide variety of products. For example, vending machines which vend soda pop, snacks, soap, trinkets, and the like presently exist. In accordance with the present state of the art, such vending machines generally consist of a fixed box having a pivotally mounted door which opens from the front end. Access to the interior confines of the vending machine is obtained by opening the pivotally mounted door for the purpose of providing the operator access to load the machine, and also, to remove monies from a coin box usually contained within the confines of the box or the door. The most common application of such a vending machine is either the vending of soda pop or snacks, wherein the pivotal door is secured to the vending box by means of a handle lock assembly generally exposed on the front surface of the door.

Perhaps the largest market for such types of vending machines are those which vend soda pop. As is commonly known, the front surface of the pivotal door generally includes a series of product selection buttons, and a coin slot for the insertion of the proper coinage in order to activate the machine. The coin slot is generally provided with a coin chute located interiorally of the door, and ultimately deposits the coinage in a coin box, once again, located somewhere within the confines of the door. In the past, the product selection buttons were located in an area of the pivotal door removed from the area where the coin box was located. Hence, once the door was locked by means of the handle lock, unauthorized access to the coin box was virtually impossible.

The locking assembly consists of a spring-loaded lock handle which reciprocates within a lock guide secured within the confines of the vending machine door. Such lock assemblies are well known, and generally consist of a handle lock which is presented along the outer surface of the door, into which a key may be inserted to open the lock, thereby causing the handle lock to be biasingly urged outwardly, permitting the operator to grasp the handle and to unthread the lock stud from an appropriate fixed aperture provided within the confines of the vending machine box. The lock assembly generally consists of a handle lock barrel which is formed integrally with the handle portion of the handle lock and located interiorly thereof, the handle lock barrel being reciprocally carried relative to a lock stud. The lock stud has an interiorly threaded end for threadedly engaging a fixed stud aperture located within the confines of the vending machine box. The handle lock barrel is slotted along the interior confines thereof, and the lock stud carries a cross pin which moves within the slots contained within the interior confines of the handle lock barrel. As is well known, when the handle lock is unlatched, and the handle springs forward, the lock stud cross-pin will be contained within the slots carried in the handle lock barrel, such that when the operator grasps the handle and turns the handle in a counterclockwise direction, the lock stud will be caused to unthread from the fixed stud aperture, thereby to permit the threaded stud to disengage the threaded aperture permitting the door to open. Hence, it will be appreciated that access to the interior confines of the vending machine box may be obtained simply by causing the handle lock to be biasingly urged into an open position by either unlocking the lock, or otherwise disengaging the bolt which secures the handle lock to the handle lock flange assembly.

The handle lock flange assembly generally consists of a lock guide formed integrally with a handle recess portion, all of which is mounted within the interior confines of the door, and carries the handle lock barrel and lock bolt therein. A principle reason for providing a handle recess as part of the handle flange assembly is so that the handle lock, when in the locked position, will be substantially flush with the vending machine door and not be available for unthreading the lock stud from the stud aperture.

The present state of the art with respect to such vending machines has now changed in a manner which has caused the product selection buttons to be located adjacent the handle lock flange assembly. The principle reason for the changes has been that companies distributing such vending machines have utilized the front door for the display of the corporate logos, and have therefore moved the product selection buttons, the handle lock, and the coin chute into one section of the door of the machine. Hence, one of the problems which has now become prevalent with this type of handle lock which includes a spring loaded handle, is the fact that unauthorized access may be gained to unlatch the handle through a product selection button permitting unauthorized entry into the interior confines of the vending machine, which results in access to the coin box and to the inventory contained in the machine. For example, standard vending machines incorporate the handle lock assembly at a point immediately next to the product selection buttons, and virtually all of the vending machines are manufactured in that manner. It has been found that a vandal or thief may simply break open one of the selection buttons adjacent to the handle lock, and will thereby gain access to the handle lock assembly. One can then use a screwdriver or other appropriate tool to force the handle lock bolt to disengage from the bolt shoulder thereby causing the handle to spring outwardly from the machine. Once that occurs, the lock stud may be unlocked by simply turning the handle to threadingly disengage the threaded stud from the threaded aperture. Hence, the entire door may be opened, leaving the unauthorized person with access to the money as well as the inventory contained within the vending machine. The solutions which have been proposed include changing the position of the lock, which would necessarily mean that the entire door panel of the vending machine door would have to be re-engineered, or otherwise changing the configuration of the lock so that an unauthorized person could not trip the handle lock bolt through one of the product selection button apertures. These solutions are, however, extremely costly in terms of design changes, and not acceptable in the field.

The present invention basically proposes to maintain the present vending machine door configuration, and to further leave the handle lock assembly intact. The present invention proposes to incorporate bolt guide shields disposed around the lock guide such that access cannot be obtained to the bolt assembly which latches the handle lock into the handle recess contained within the handle lock assembly.

OBJECTS AND ADVANTAGES

It is therefore the principle object of the present invention to provide an improved handle lock assembly of the type generally incorporating a handle lock as presently exists in the state of the art, and to incorporate therein certain lock bolt shields surrounding a portion of the lock guide of the assembly such that unauthorized access to the latching mechanism cannot be had regardless of disposition of the lock, or the point of access through product selection buttons to the handle lock assembly.

In conjunction with the foregoing object, it is a primary object of the present invention to provide a handle lock assembly of the type generally including a handle lock barrel reciprocally carried relative to a lock stud, the lock stud having an interiorly threaded end for threadedly engaging a fixed stud aperture, the handle lock barrel and lock stud being carried within the confines of a fixed lock guide formed integrally with a handle flange including a handle recess into which the handle lock may be lockingly secured by a bolt provided in the handle lock, the bolt for securing the handle lock barrel to the bolt guide locking against a bolt shoulder provided in the handle flange, the improvement consisting of bolt guide shield means carried on the bolt guide and extending for a distance down the length thereof and completely encircling and enclosing a portion of the lock guide in a manner sufficient to prevent access to the bolt securing the handle lock relative to the handle flange when in the locked position, the bolt guide shield means being formed integrally with the lock guide.

In conjunction with the foregoing object, it is a further object to provide an improved handle lock assembly of the type described, wherein the bolt guide shield means consists of a shield plate formed on each side of the lock guide and extending for a distance sufficient to overlie the point of bolt securement as between the bolt for securing the handle lock and the bolt shoulder formed in the handle flange, such that the handle portion of the handle lock cannot be unlatched to biasingly urge the handle into its open configuration regardless of the point of access or entry to the handle lock assembly.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is a plan view of a typical vending machine incorporating therein a handle lock assembly of the type described herein, and showing the means of unauthorized access and entry into handle lock assembly and the vending machine;

FIG. 2 is a perspective view showing a standard handle lock assembly of the type commonly used in vending machines, and further illustrating the provision of bolt guide shield means in accordance with the present invention;

FIG. 3 is a side elevational view, in cross section, showing the mode of operation of the handle lock assembly, and the provision of bolt guide shield means to protect the handle bolt against unauthorized access;

FIG. 4 is a front elevational view, in cross section, taken in the direction of the arrows along the line 4—4 of FIG. 3;

FIG. 5 is a perspective view, partly in cross section, showing the handle lock in its open position, and the positioning of the bolt guide shield means relative to the lock guide forming a part of the handle lock assembly;

FIG. 6 is a rear perspective view of the handle lock assembly of the present invention illustrating the manner in which the bolt guide shield means completely encircle and enclose a portion of the lock guide;

FIG. 7 is a perspective view, partly broken away, showing a handle lock assembly of the type prsently in use, and as described in U.S. Pat. No. 3,089,330, and illustrating the manner in which unauthorized access may still be had to the lock bolt locking the handle in position; and FIG. 8 is a rear perspective view, partly broken away, showing still another version of a prior art handle lock assembly presently in use, and illustrating the manner in which unauthorized access may still be had through the lock bolt aperture despite the fact that the greater portion of the lock guide appears to be enclosed.

BRIEF SUMMARY OF THE INVENTION

In summary, the present invention provides bolt guide shield means associated with a typical handle lock assembly of the type including a bolt guide formed integrally with a handle flange, which accommodates within the interior confines therein a handle lock barrel, which operates in conjunction with a lock stud for lockingly engaging a stud aperture fixedly secured within the interior confines of the vending machine. The handle lock includes a bolt for securing the handle lock barrel to the lock guide against a bolt shoulder provided in the handle flange assembly. The bolt guide shield means operates to prevent unauthorized access to the bolt which secures the handle lock within the confines of the handle lock recess in order to prevent the handle lock from being unlatched without the use of the key, which would in turn permit the lock stud to be disengaged from the stud aperture in order to open the vending machine door. The bolt guide shield means completely encircles and encloses that portion of the lock guide where the lock bolt is located thereby preventing access to the lock bolt when in the locked position.

The present invention thereby permits the presently existing handle lock assemblies, in their present format, to be utilized and further permits the design of the vending machine door to remain intact, while at the same time, solving the problem of unauthorized access to the interior confines of the vending machine. As such, the present invention avoids the problem of reengineering the vending machine doors, and/or the handle lock assemblies presently in existence.

DETAILED DESCRIPTION OF INVENTION

With respect to FIG. 1 of the drawings, FIG. 1 represents a typical soda pop machine 10 which is formed by product compartment box 12 which is enclosed by vending machine door 14 which is typically secured to the box 12 in the manner customarily known in the art. As is typical with such vending machines, product selection buttons 16 are generally positioned in the door 14 such that upon insertion of the proper coinage into the machine in the coin slots provided, the user may select the product to be vended by pressing the appropriate product selection button 16. In addition, it is customary that a coin collection box 18 is positioned either in the door 14, or in the compartment box 12, and is positioned in registry with the coin slot so that coins inserted into the machine 10 will be collected in the box 18.

As is also customarily known in the art field, the handle lock assembly 20 is generally employed in such vending machines 10 for the purpose of lockingly engaging the door 14 with respect to the compartment box 12. The construction of the handle lock assembly 20 is again well known in the art field, and is formed by a handle flange 22 provided with a pair of opposed mounting ears 23 and 24 respectively. As shown in FIG. 5 of the drawings, the mounting ears 23 and 24 are adapted to contain mounting bolts 25 and 26 respectively (see FIG. 5) which mounts the handle flange 22 to the interior portion of the door 14. With reference to FIGS. 2 and 5 of the drawings, it should further be realized that the subject handle lock assembly 20 comes in two formats, FIG. 2 illustrating the format with the mounting ears 23 and 24 respectively located in directly opposed juxtaposition, and at a right angle configuration as shown in FIG. 5, wherein the mounting ears 23 and 24' are adapted to be mounted at the corner of the door, with the mounting ear 24' being at right angles relative to mounting ear 23. These two versions of the handle flange 22 are manufactured for the reason that vending machines 10 have doors which are engineered to accommodate either of these two mounting configurations. However, both are standard in the art field.

The handle lock assembly 20, as a matter of standard construction, includes an outer handle 28 which accommodates a lock mechanism 30 therein. The lock mechanism 30 is provided with a bolt 32 which, when in the locked position, abuts against a bolt shoulder 33 formed along the inner portion of the handle flange 22. As is evident from FIGS. 2 and 3 of the drawings, the handle lock barrel 35 is spring loaded in the lock 30, and operates to abut against the bolt shoulder 33 by being biasingly urged through an appropriate bolt aperture 34 provided in the handle lock barrel 35. The handle lock barrel 35 has a hollow interior, and accommodates a lock stud 38 along the interior confines thereof. The lock stud 38 further includes a cross pin 39 (FIG. 4) fixedly secured to the inner end thereof, the cross pin 39 riding in a pair of opposed pin slots 41 formed along the interior confines of the handle lock barrel 35. The inner rear portion of the lock stud 38 is provided with a spring shoulder 43, while the outer portion of the rear end of lock stud 38 is shown to include a threaded portion 44. Again, as is typical in such installations, an inner wall member 13 of the compartment box 12 is provided with a stud aperture 15 into which the threaded portion 44 of the lock stud 38 may be screw threadedly secured. The handle lock barrel 35 is similarly provided with a spring shoulder 46 such that a coil spring 48 is positioned between the respective spring shoulders 43 and 46.

The handle lock barrel 35 is also shown to include at least one elongated lock rail 50 which rides into a rail groove 52 formed along the interior wall of the lock guide 54.

The handle lock assembly 20 is completed by means of the provision of the fixed lock guide 54 which is formed integrally with the handle flange 22 and extends, in operation, into the confines of the vending machine door 14.

In operation, the handle lock assembly 20 operates in the following manner. When the operator inserts the appropriate key into the lock mechanism 30 and turns the lock mechanism 30 to the open position, the bolt 32 is retracted into the lock mechanism 30 and thereby rides out of engagement with the bolt shoulder 33. The biasing action of the coil spring 48 pushes against the handle lock barrel 35 causing the handle 28 to be ejected out of the flange handle recess 37. This action also causes the lock rail 50 to ride out of the rail groove 52, and now permits the operator to grasp the handle 28, in order to unscrew the threaded portion 44 of the lock stud 38 from the stud aperture 15. It will be appreciated that the counterclockwise movement of the handle lock barrel 35 will cause a concommitant counterclockwise movement of the lock stud 38 due to the positioning of the cross pin 39 in the opposed pin slots 41 formed in the interior confines of the handle lock barrel 35. Hence, movement of the handle 28 through a counterclockwise movement causes an unscrewing action of the threaded portion 44 relative to the stud aperture 15.

In reverse, when the operator desires to lock the door 14 relative to the compartment box 12, the door 14 is closed relative to the box 12, and the handle 28 is then grasped and moved in a clockwise motion in order to threadingly screw the threaded portion 44 into the stud aperture 15. Once the lock stud 38 is secure in the stud aperture 15, the operator merely depresses the handle 28 into the handle recess 37 a sufficient distance until the bolt 32 engages the bolt shoulder 33.

As briefly illustrated in FIG. 1 of the drawings, the field has now determined that unauthorized entry may be obtained by taking an implement such as a screwdriver 60 or the like, breaking out one of the product selection buttons 16 which is adjacent to the handle lock assembly 20. The thief or other unauthorized person then has access to the bolt 32 through the lock guide 54, and may utilize the tool such as a screwdriver 60 or the like, to force the bolt 32 out of engagement with the bolt shoulder 33. Once that is achieved, the spring 48 will pop the handle 28 into the open position as shown in FIG. 2, permitting the thief to unscrew the lock stud 38 relative to the stud aperture 15. Hence, access to the interior confines of the compartment box 12 may be had with relative ease.

FIGS. 7 and 8 of the drawings illustrate prior art devices which clearly indicate the manner in which unauthorized access may be had to disengage the lock bolt 32 from the bolt shoulder. Specific reference to FIG. 7 of the drawings, a device illustrated in U.S. Pat. No. 3,089,330 is shown. As indicated in the aforenoted patent, the handle flange is provided with what is referred to as the hood 142, which overlies the bolt 32. While the hood 142 appears to function in the same manner as the shields 56 of the present invention, as illustrated in FIG. 7 of the drawings, a screwdriver 60 may still be applied beneath the hood 142 in order to disengage the bolt 32 from the bolt shoulder (not shown). Indeed, as is indicated in U.S. Pat. No. 3,089,330, the bolt 32 is a separate element with respect to the lock (not shown) contained in the handle lock assembly, and it was found that when the handle lock was inserted into the handle lock recess, with the bolts 32 engaging the bolt shoulder, the bolt could spring out of its seatment, unless some structure was inserted to prevent the bolt from being ejected. It was for this reason that the hood 142 was formed as a separate element on the handle flange, strictly for the purpose of retaining the bolt in position. However, it was determined that due to the location of the product selection buttons 16, on current versions of vending machines, one of the buttons 16 could still be removed or broken away, and an implement such as a screwdriver 60 inserted therein, and positioned under the hood 142 in order to disengage the bolt 32. As indicated previously, this would cause the handle to pop open, permitting an unauthorized person to simply unscrew the lock stud from the lock aperture thereby to open the vending door.

FIG. 8 of the drawings illustrate still another version of a prior art lock assembly wherein there is shown a handle flange 62 which includes a lock guide 64 formed integrally therewith. In this version, the lock guide 64 includes a series of four bolt holes 66, two of which are shown in FIG. 8 of the drawings, which are positioned at offsetting positions down the length of the lock guide 64. Hence, while it would appear that the lock guide 64 is enclosed, nevertheless, in order to accommodate a lock mechanism within the confines of the lock guide 64, the bolt holes 66 are provided therein. As indicated, there are four bolt holes 66 provided, one along each side of the lock guide 64, and positioned at different linear settings along the length of the lock guide 64. The reason for such different positions is that different locks are employed in such mechanisms, and the holes 66 are designed to accommodate any one of the numerous cylinder locks which are utilized in such assemblies. However, as shown in FIG. 8 of the drawings, once again where a handle flange assembly of the type shown in figure 8 is employed in a typical vending machine, given the location of the product selection buttons 16, a button 16 may still be removed or knocked out, and by the use of an implement such as a screwdriver 60, access may still be had to the lock bolt in order to disengage the same from the bolt shoulder and thereby to pop the handle open permitting unauthorized access to the machine.

It will be appreciated from the above discussion that prior art handle flange assemblies, and those presently existing in the state of the art, have not been constructed in a manner to prevent unauthorized access despite the fact that a product selection button 16 may be removed or broken by an unauthorized person. Hence, the handle flange assembly of the present invention, by providing bolt shield means totally encircling and enclosing the lock guide for a portion of the length thereof in the area where the lock bolt engages the lock shoulder, has now alleviated the problem experienced in the field.

In accordance with the present invention, the configuration of the lock guide 54 has been modified, by providing a series of bolt shields 56 along each of the sides around the lock guide 54. Each of the bolt shields 56 is shown to be formed integrally with the handle flange 22, and extends rearwardly for a sufficient distance thereby to completely encircle and enclose the lock guide 54 along that portion where the lock bolt 32 engages the lock shoulder 33. It will therefore be appreciated that according to the present invention, the lock guide in combination with the bolt shields prevents the lock bolt from being located by the unauthorized person since the lock bolt is not visible from any angle. Hence, regardless of the unauthorized removal of a product selection button, it is impossible to even locate the lock bolt, much less to gain access to it to achieve unauthorized entry.

With reference to FIGS. 2 and 4 of the drawings, it will be noted that at least two bolt apertures 34 are provided in the handle lock barrel 35 primarily due to the fact that depending upon the type of lock mechanism 30 which is utilized, and the configuration of the particular handle lock assembly 20 utilized, the bolt 32 is designed to abut against the bolt shoulder 33, given the fact that the entire assembly 20 may be configured either as shown in FIG. 1 of the drawings, wherein it is in an upright position, or as shown in FIG. 5, where it is in a horizontal position, the handle lock barrel 35 must be designed to permit the bolt 32 to lock against the bolt shoulder 33. It is for this reason that more than one bolt aperture 34 is designed into the handle lock barrel 35. Regardless of which configuration is utilized, the same result obtains since a thief or other unauthorized person may still obtain access to the top portion of the lock guide 54 by breaking out an appropriate product selection button 16, and inserting a tool 60 into the machine whereby to disengage the bolt 32 from the bolt shoulder 33 causing the handle 28 to be biasingly forced out of the recess 37.

As shown in both FIGS. 2 and 5 of the drawings, regardless of which orientation the entire handle lock assembly 20 is configured, depending upon the type of vending machine 10 involved, the bolt shields 56, by being provided around the entire circumference of the lock guide 54, will operate to prevent unauthorized tampering with the bolt 32 relative to the bolt shoulder 33.

It will be appreciated that from a cost standpoint, the only change that need be made to the entire assembly is to cast the handle flange 22 to incorporate bolt shields 56 thereabout, in order to eliminate the problem of unauthorized entry thereto. It will be appreciated that no changes need be made to the vending machine door 14, nor to the compartment box 12, and indeed, no further changes need be made to the lock assemblies utilized in conjunction with such machines. From a manufacturing standpoint, very little extra cost in terms of the manufacturing process is involved in view of the fact that the casting only need be changed a slight degree to accommodate the casting of the shield guides 56 in conjunction with the formation of the lock guide 54. Therefore, both versions of the handle lock assembly 20, as shown in both FIGS. 2 and 5 of the drawings, may incorporate the structure of the present invention without any further modifications or expense.

While there has been described what is at present considered to be the preferred embodiments of the invention, it will be understood that various modifications may be made therein and it is intended to cover in the appended claims all such modifications as followed in the true spirit and scope of the invention.

I claim:

1. In a handle lock assembly of the type including a handle formed integrally with a handle lock barrel reciprocally carried relative to a lock stud, the lock stud having an interiorly threaded end for threadedly engaging a fixed stud aperture, the handle lock barrel and lock stud being carried within a fixed lock guide formed integrally with a handle flange which includes a handle recess into which the handle may be lockingly secured by a bolt provided in the lock carried in the handle for securing said handle within the confines of the handle shaft, the improvement comprising, bolt shield means carried on said lock guide extending for a short distance down the length of said lock guide sufficient to prevent access to the bolt securing the handle relative to the handle flange when in the locked position, said bolt shield means formed integrally with said lock guide, said bolt shield means and said lock guide together totally encircling and enclosing that portion of the lock guide wherein the bolt securing the handle relative to the handle flange is positioned, whereby unauthorized access to the bolt securing the handle lock within the handle recess when in the locked position is obviated.

2. The improved handle lock assembly as set forth in claim 1 above wherein said bolt shield means comprises a shield plate formed on each side of said lock guide and extending interiorly for a distance down the length of said lock guide sufficient to overlie the bolt formed in the handle barrel of said handle lock assembly, and to overlie the point of bolt securement as between the bolt, and the bolt shoulder formed in the handle flange, whereby unauthorized access to the bolt is obviated from all circumferential points of access.

* * * * *